US006017299A

United States Patent [19]

Ratzel

[11] Patent Number: 6,017,299

[45] **Date of Patent: *Jan. 25, 2000**

[54] CUSHIONING CONVERSION MACHINE, METHOD AND PRODUCT

[75] Inventor: Richard O. Ratzel, Westlake, Ohio

[73] Assignee: Ranpak Corp., Concord Township, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/888,150

[22] Filed: Jul. 3, 1997

[51] Int. Cl.[7] ..... B31B 1/00

[52] U.S. Cl. ..... 493/464; 493/967

[58] Field of Search ..... 493/464, 967, 493/354, 352, 357, 390, 407, 359

[56] References Cited

U.S. PATENT DOCUMENTS

| | | | |
|---|---|---|---|
| 1,571,594 | 2/1926 | Lorenz | 493/464 |
| 1,989,794 | 2/1935 | Duvall . | |
| 2,537,026 | 1/1951 | Brugger . | |
| 3,377,224 | 4/1968 | Gresham et al. . | |
| 3,799,039 | 3/1974 | Johnson | 493/464 |
| 4,026,198 | 5/1977 | Ottaviano | 493/464 |
| 4,690,344 | 9/1987 | Yokota . | |
| 4,699,031 | 10/1987 | D'Angelo et al. . | |
| 4,968,291 | 11/1990 | Baldacci et al. . | |
| 5,123,889 | 6/1992 | Armington et al. . | |
| 5,131,903 | 7/1992 | Levine et al. . | |
| 5,203,761 | 4/1993 | Reichental et al. . | |
| 5,207,756 | 5/1993 | Alhamad et al. . | |
| 5,340,638 | 8/1994 | Sperner . | |
| 5,538,778 | 7/1996 | Hurwitz et al. . | |
| 5,558,923 | 9/1996 | Vesamaa | 493/967 |
| 5,573,491 | 11/1996 | Parker | 493/464 |
| 5,643,167 | 7/1997 | Simmons . | |

FOREIGN PATENT DOCUMENTS

| | | |
|---|---|---|
| 94440027 | 11/1995 | European Pat. Off. . |

*Primary Examiner*—Eugene L. Kim

*Attorney, Agent, or Firm*—Renner, Otto, Boisselle & Sklar, P.L.L.

[57] ABSTRACT

A cushioning conversion machine includes a plurality of laterally spaced apart upstream assemblies which advance the sheet stock material with a transversely reciprocating twisting motion and at least one downstream assembly that retards the advance of the stock material. Additionally, the upstream assemblies feed the sheet stock material at a feed rate greater than the feed rate at which the downstream assembly passes the sheet stock material. The downstream assembly thereby cooperates with the upstream assemblies to crumple the stock material and impart loft thereto, and as a further result, the crumpled stock material includes a regular arrangement of folds preferably forming a herringbone pattern.

21 Claims, 10 Drawing Sheets

CUSHIONING CONVERSION MACHINE, METHOD AND PRODUCT

FIELD OF THE INVENTION

The invention relates generally to a conversion machine and a method for converting sheet stock material into a cushioning product. More particularly, the machine and method produce a cushioning surface wrap.

BACKGROUND OF THE INVENTION

In the process of shipping an item from one location to another, a protective packaging material is typically placed in the shipping container to fill any voids and/or to cushion the item during the shipping process. Some commonly used protective packaging materials are plastic foam peanuts and plastic bubble wrap. While these conventional plastic materials seem to perform adequately as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

The foregoing and other disadvantages of conventional plastic packaging materials have made paper protective packaging material a very popular alterative. Paper is biodegradable, recyclable and composed of a renewable resource; making it an environmentally responsible choice for conscientious companies.

While paper in sheet form could possibly be used as a protective packaging material, it is usually preferable to convert the sheets of paper into a relatively low density pad cushioning dunnage product. This conversion may be accomplished by a cushioning conversion machine, such as those disclosed in U.S. Pat. No. 4,968,291, U.S. Pat. No. 5,123,889 or European Patent Application No. 94440027.4. Such a cushioning conversion machine includes a frame having an upstream end and a downstream end, a stock supply assembly which supplies a continuous web of the sheet stock material, a conversion assembly which converts the sheet stock material into a continuous strip of a cushioning product, and a severing assembly which cuts the strip into sections of a desired length. The conversion assembly includes a folding or forming assembly which inwardly folds the lateral edges of the sheet stock material and a feed assembly which contacts a central section of the folded stock material. With particular reference to the machine disclosed in European Patent Application No. 94440027.4, the feed assembly crumples the folded portions of the stock material.

These earlier cushioning conversion machines produce a cushioning product having lateral pillow portions and a thinner central connecting portion. Such cushioning products are used to fill the voids between the item to be shipped and its container. However, in some packaging situations, a "flatter" cushioning product, or a product having less loft, may be more appropriate. For example, a "flatter" cushioning product may be more advantageous for placement between relatively flat items, such as plates and/or for the individual "surface wrapping" of articles such as fragile ornaments, glass hurricane lamps or the wooden legs on fine furniture. It would be desirable to have a flatter cushioning product with the flexibility to wrap around fragile and unusually shaped objects and which still functions to cushion and/or protect the object from damage.

SUMMARY OF THE INVENTION

The present invention provides a novel cushioning conversion machine and method which may be used to produce a "flatter" cushioning product or surface wrap than those produced by prior machines and methods. Additionally or alternatively, the present invention provides a cushioning conversion machine/method in which the sheet stock material is supplied in lengths related to the desired length of the cushioning product whereby a severing assembly is not necessary.

According to one aspect of the invention, the cushioning conversion machine includes a plurality of laterally spaced apart upstream assemblies which advance the sheet stock material with a transversely reciprocating motion and at least one downstream assembly which retards the advance of the stock material. The upstream assemblies feed the sheet stock material at a feed rate greater than the feed rate at which the downstream assembly passes the sheet stock material. The downstream assembly thereby cooperates with the upstream assemblies to crumple the stock material and impart loft thereto.

In a preferred embodiment of the invention, each upstream assembly includes a support wheel and a feed wheel. The feed wheel has an annular rib thereon which fits within an annular groove in the support wheel. The support wheel of each upstream assembly has axial end portions on either side of the annular groove, and each axial end portion has a plurality of flat faces alternating with arcuate areas about the circumference thereof. The flat faces of one axial end portion preferably are transversely aligned with the arcuate areas of the other axial end portion, and the arcuate areas may have a friction enhanced surface.

Further in accordance with a preferred embodiment of the invention, each downstream assembly includes a support wheel and a compression wheel. The support wheel has a friction enhanced surface for gripping the crumpled stock material and creasing the folds against the compression wheel.

The cushioning conversion machine may also include a stock supply assembly adapted to supply the sheet stock material in lengths related to a desired length of the cushioning product. Alternatively or additionally, the cushioning conversion machine may include a stock supply assembly adapted to supply a continuous web of the sheet stock material from which the upstream and downstream assemblies will produce a continuous web having crumpled portions. The cushioning conversion machine may also include a severing assembly for severing the continuous web into sections of a desired length.

According to another aspect of the invention, a cushioning conversion machine for converting sheet stock material into cushioning products of a desired length includes a conversion assembly which converts discrete lengths of sheet stock material into cushioning products. The conversion assembly includes a plurality of laterally spaced apart upstream assemblies which feed the stock material with a transversely reciprocating twisting action and at least one downstream assembly which retards the advance of the stock material. The downstream assembly cooperates with the upstream assemblies to crumple discrete lengths of the stock material and impart loft thereto.

According to another aspect of the invention, a method of making a cushioning product from sheet stock material includes the steps of: advancing the sheet stock material through a plurality of laterally spaced apart upstream assemblies in a transversely reciprocating manner; and retarding the advancement of the stock material through at least one downstream assembly downstream of the upstream assemblies. In this way the stock material becomes crumpled through the cooperation of the advancing and retarding steps.

As is preferred, the upstream assemblies operate to feed the sheet stock material at a feed rate greater than the feed rate at which the downstream assembly operates to feed or pass the sheet stock material therethrough. As is also preferred, the retarding step includes creasing the crumpled stock material so that the cushioning product retains a crumpled resilient state.

According to another aspect of a preferred method, a supplying step may include supplying sheet stock material having lengths related to a desired length of the cushioning product. Alternatively, the supplying step may include supplying sheet stock material as a continuous web whereby the converting step will produce a continuous web having crumpled portions. The method may also include the step of severing the continuous web into sections of a desired length.

As is preferred, the sheet stock material is biodegradable, recyclable, and made from a renewable resource. Most preferably, the sheet stock material is paper, and more particularly, Kraft paper, and is composed of a plurality of superimposed plies of Kraft paper.

The invention also provides a surface wrap produced by the conversion machine and/or method described above. In addition, there is provided a method of surface wrapping an article for cushioning purposes, such method including the step of wrapping the surface wrap around the surface of the article.

A preferred embodiment of surface wrap according to the invention includes a flat sheet stock material having a plurality of narrow, compressed feeding trails alternating with wide cushioning crumpled zones having a plurality of folds. The folds in the crumpled zones include a somewhat regular arrangement of folds preferably forming a herringbone pattern.

The foregoing and other features of the invention are hereinafter fully described and particularly pointed out in the claims, the following description and annexed drawings setting forth in detail certain illustrative embodiments of the invention, these embodiments being indicative, however, of but a few of the various ways in which the principles of the invention may be employed.

DETAILED DESCRIPTION OF THE INVENTION

Figure 1:
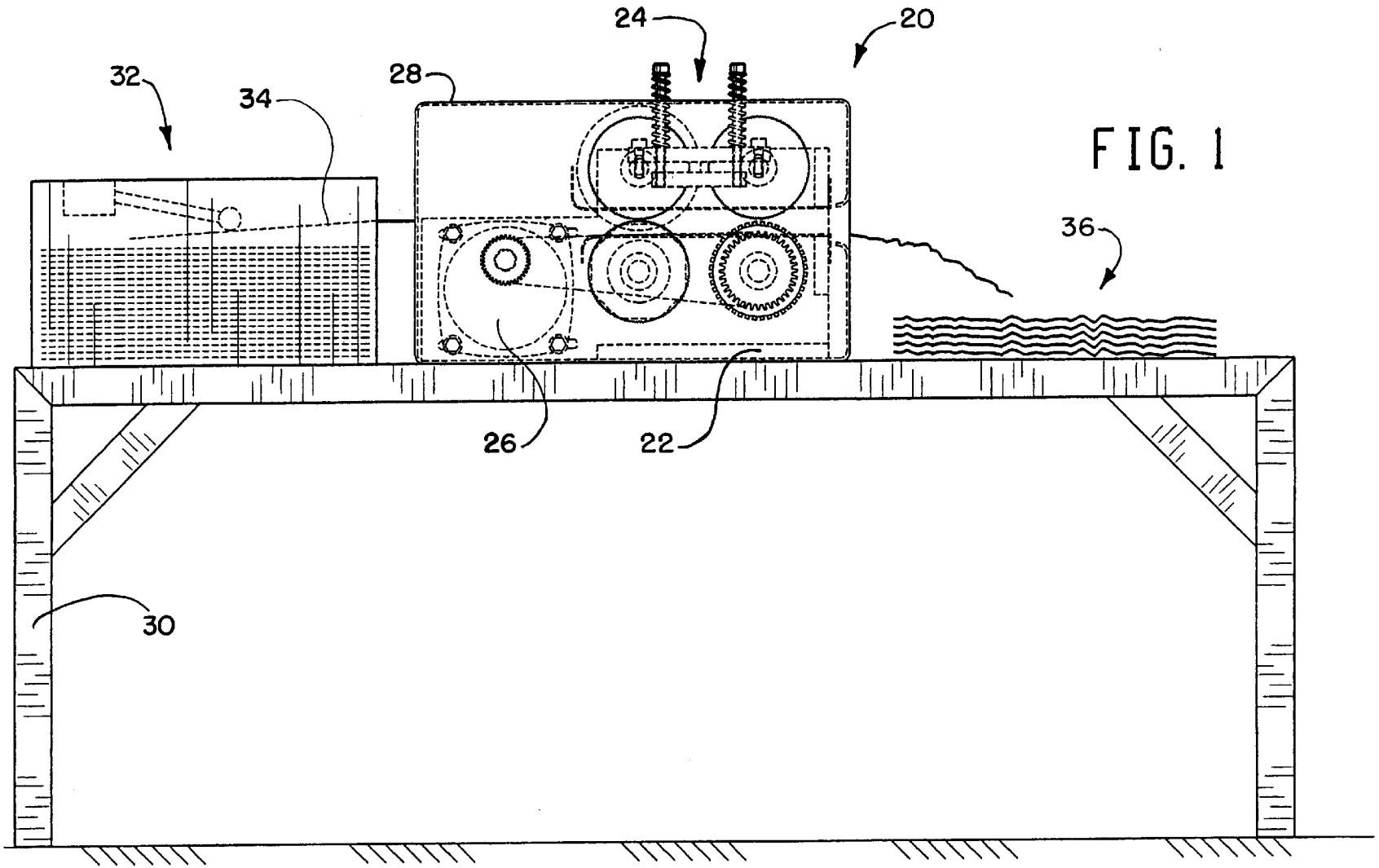
FIG. 1 is a side view of a cushioning conversion machine according to the invention with the side wall of the machine's outer casing nearest the viewer broken away to permit viewing of internal machine components, and with the machine situated on a table and being supplied with precut sheets of stock material from a cartridge placed on the table.
Figure 2:
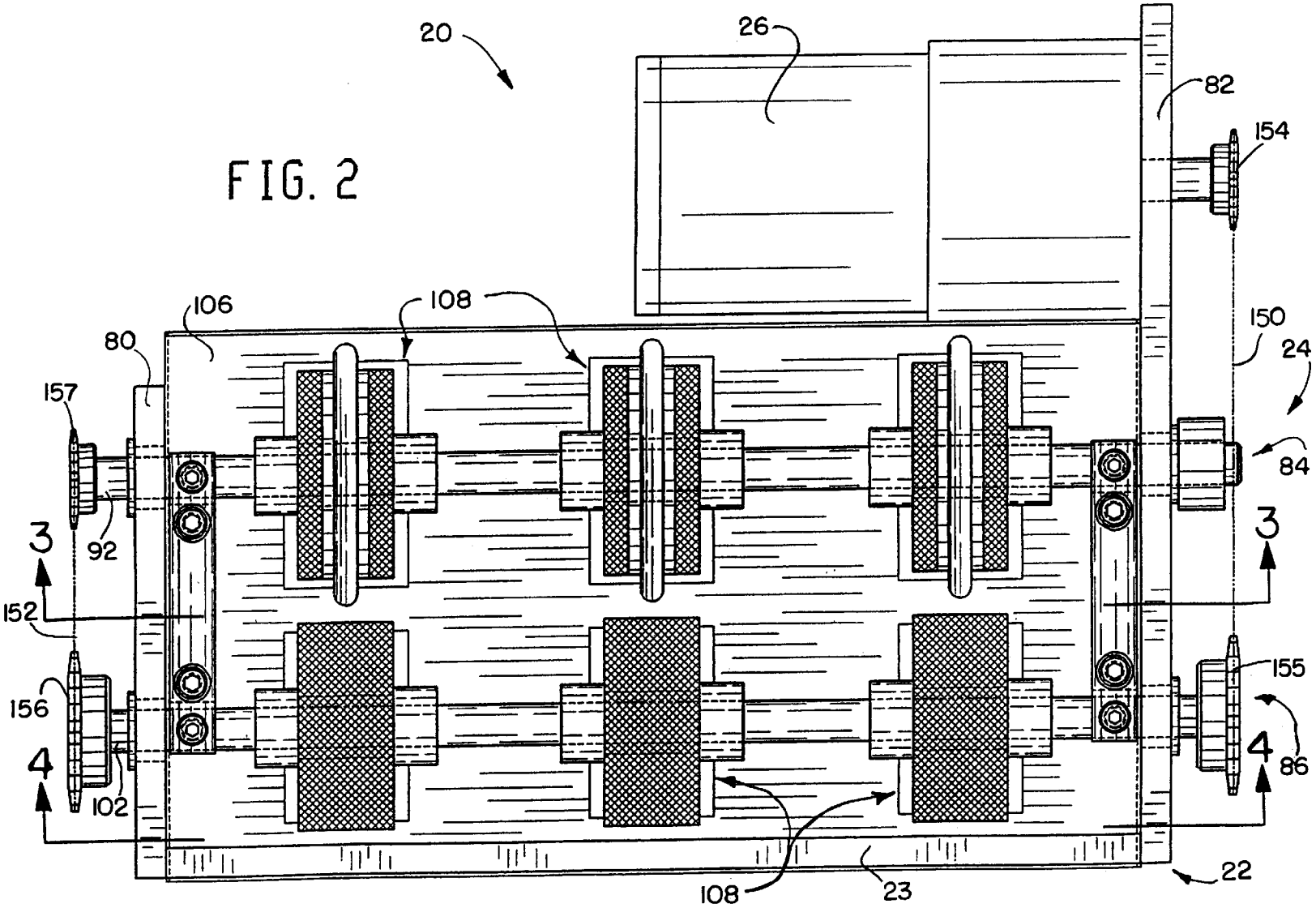
FIG. 2 is a top plan view of the internal components of the cushioning conversion machine of FIG. 1 and particularly upstream and downstream assemblies thereof.

Referring now in detail to the drawings and initially to FIG. 1, an exemplary embodiment of a cushioning conversion machine according to the invention is designated generally by reference numeral 20. The illustrated machine 20 converts sheet stock material (the thickness thereof being negligible to the length and width thereof, thus essentially two-dimensional) into a relatively three-dimensional cushioning product for use as a surface wrap 36.

The machine 20 includes a frame 22 to which is mounted a feeding and crumpling assembly 24 and a motor 26 for driving the feeding and crumpling assembly 24. The machine 20 preferably is provided with an outer casing 28 which encloses the frame 22, feeding and crumpling assembly 24, and other interior components of the machine 20.

As illustrated in FIG. 1, the cushioning conversion machine 20 may be set upon a table 30 to dispense a cushioning product at a convenient height for use. A cartridge 32 supplies cut sheet stock material 34 to the cushioning conversion machine 20, which then produces the cushioning surface wrap 36. The cartridge 32 includes a mechanism for delivering individual or discrete sheets from a stack thereof to appropriate guides (not shown) and into the feeding and crumpling assembly 24.

A preferred stock material consists of one or more plies or layers of biodegradable and recyclable sheet stock material made from a renewable resource. Such a stock material is preferably 30 to 50 pound basis weight Kraft paper. The resulting crumpled sheet stock material has greater loft (i.e., lower density) than the uncrumpled sheet stock material.

Figure 3:
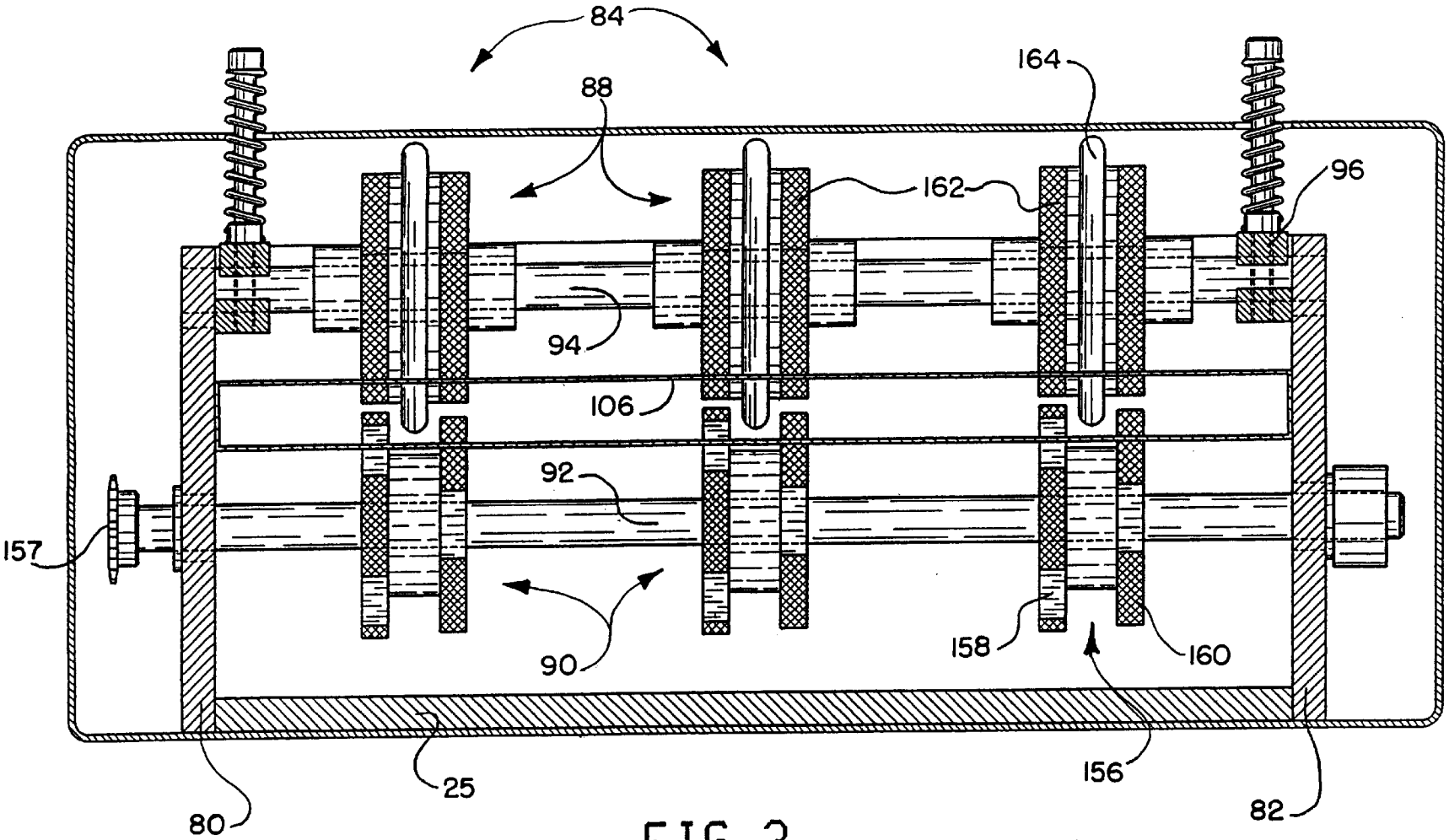
FIG. 3 is a sectional view taken along the line 3—3 of FIG. 2, illustrating the upstream assemblies.
Figure 4:
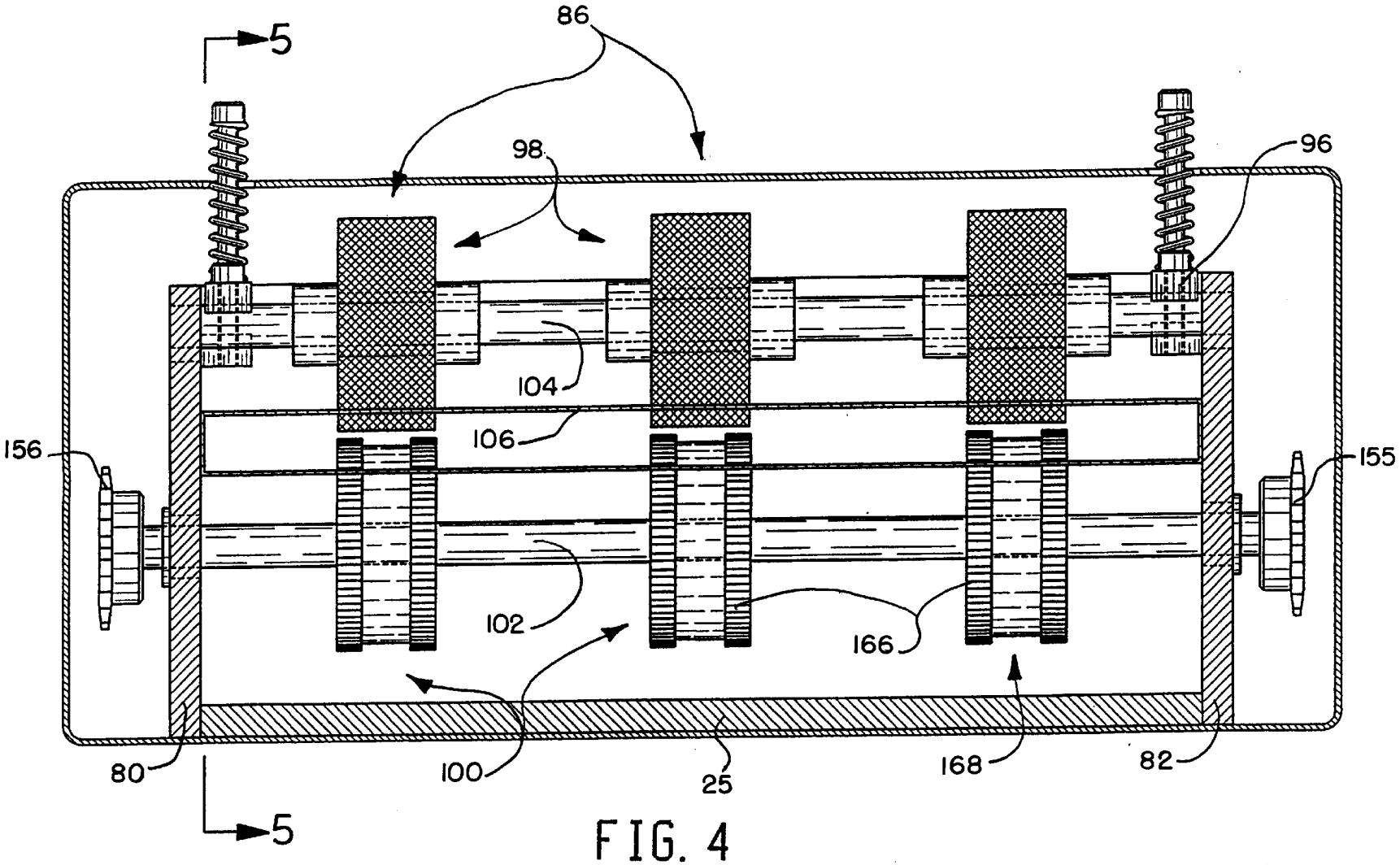
FIG. 4 is a sectional view taken along the line 4—4 of FIG. 2, illustrating the downstream assemblies.
Figure 7:
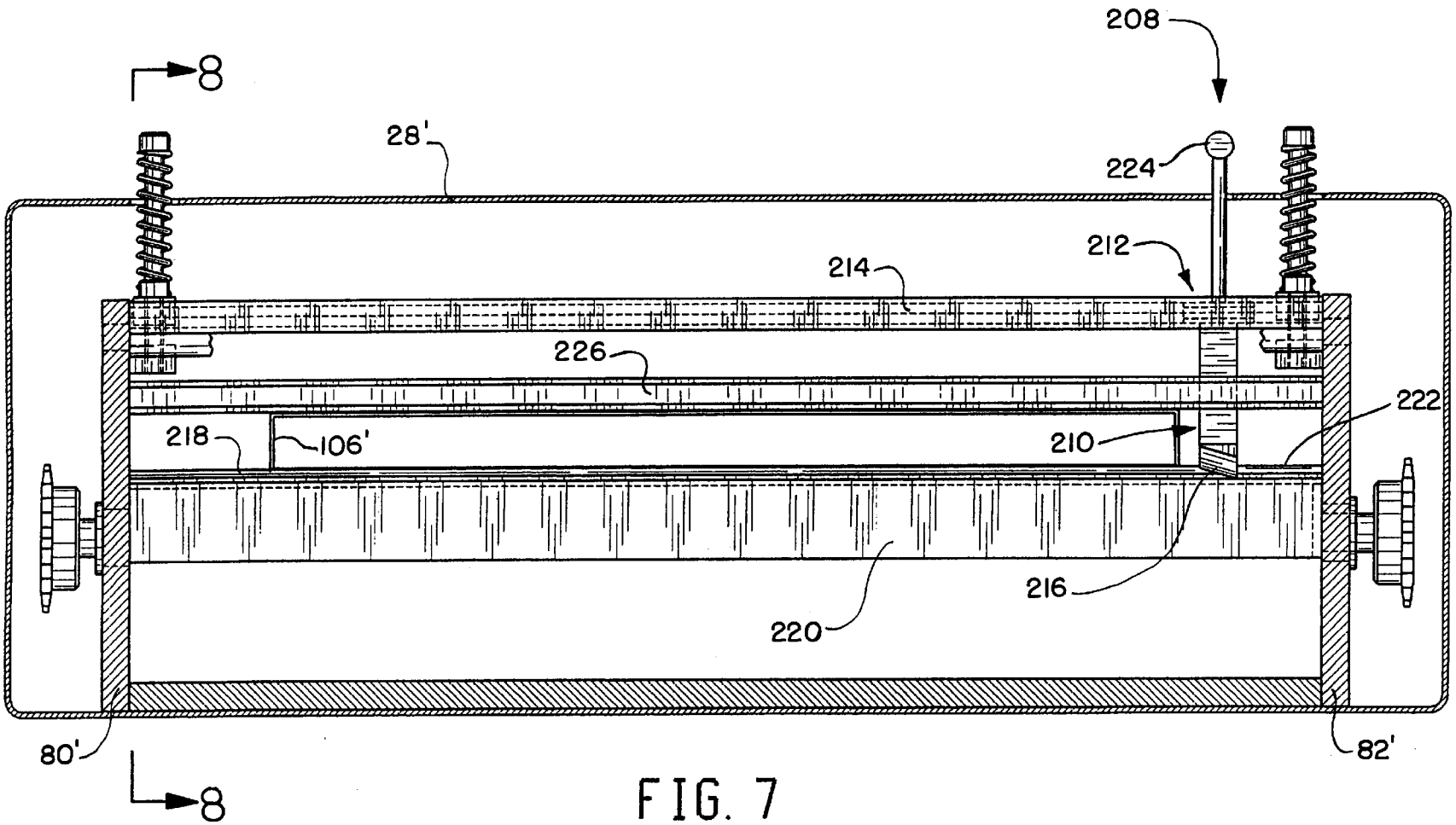
FIG. 7 is a front view of a severing assembly in the machine.

Referring now to FIGS. 2 through 5, wherein further details of the cushioning conversion machine 20 are shown, the frame 22 can be seen to include side plates 80 and 82 which are joined together by transverse frame members 23 (FIG. 2) and 25 (FIGS. 3, 4 and 7). The feeding and crumpling assembly 24 includes a plurality of upstream assemblies 84 and one or more downstream assemblies 86 mounted between the side plates 80 and 82 downstream of the upstream assemblies 84. (The terms "upstream" and "downstream" are used herein in relation to the direction of flow of the stock material through the machine, from an upstream end toward a downstream end.)

As seen in FIG. 3, each of the upstream assemblies 84 includes an upper support wheel 88 and a lower feed wheel 90. The feed wheel 90 is fixed to a feed shaft 92 that is rotatably supported by and between the side plates 80 and 82. The support wheel 88 is supported for rotation on a first support shaft 94 which has opposite ends thereof attached to respective floating supports 96 in the form of bars.

Looking to FIG. 4, the downstream assemblies 86 each comprise an upper support wheel 98 and a lower compression wheel 100. The compression wheel 100 is fixed to a compression shaft 102 that is rotatably supported by and between the frame side plates 80 and 82. The support wheel 98 is supported for rotation on a second support shaft 104 which has opposite ends thereof respectively attached to the floating supports or bars 96 downstream of the first support shaft 94 (See FIG. 5).

Figure 5:
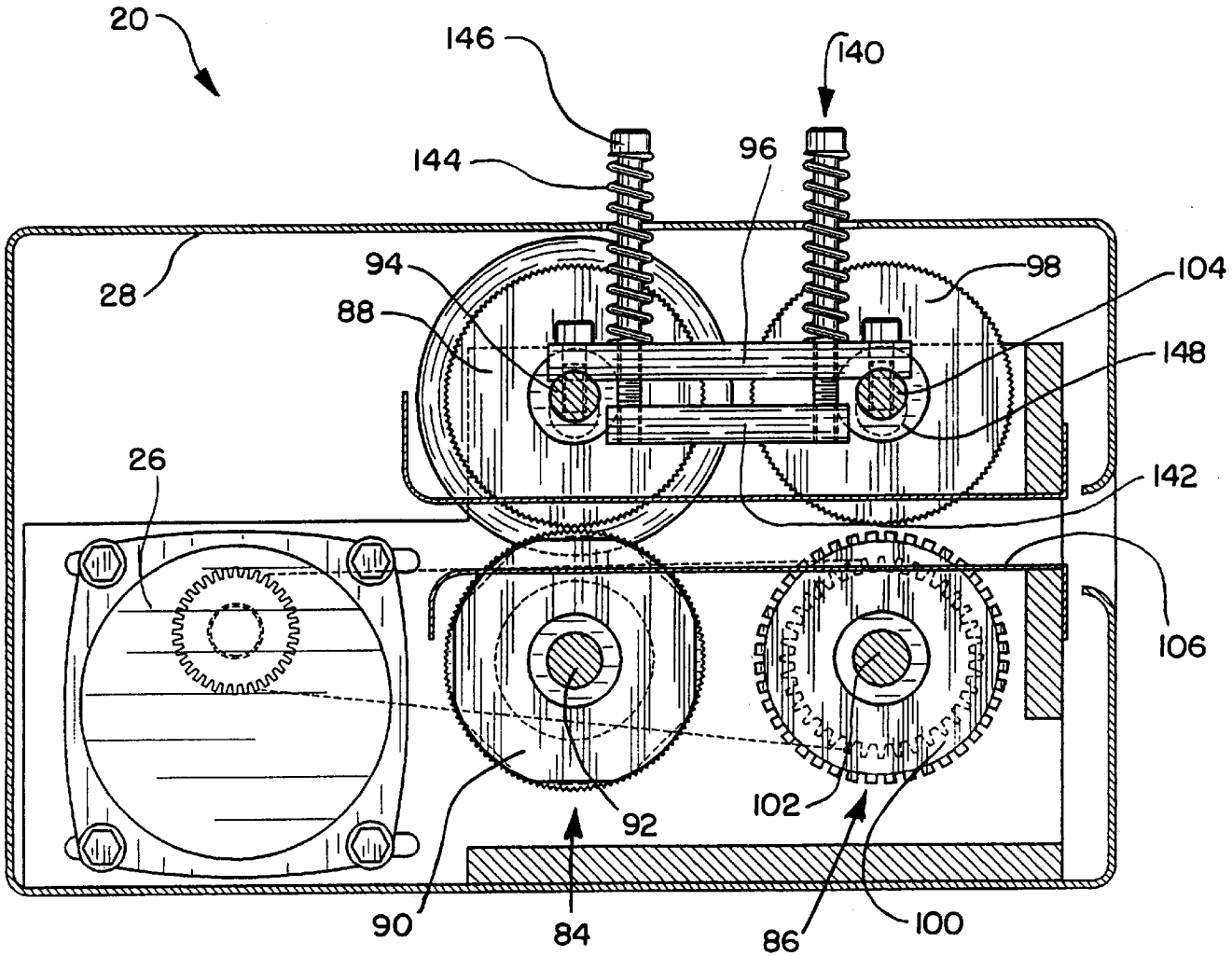
FIG. 5 is a sectional view taken along the line 5—5 of FIG. 4.

Turning to FIG. 5, each floating bar 96 has a pair of guide holes through which a pair of guide pins 140 extend. The guide holes in the floating bars 96 preferably are oversized in relation to the guide pins 140. The ends of the shafts 94 and 104 are guided in elongated slots 148 in the side plates 80 and 82 (FIG. 2), which slots extend substantially perpendicular to the path of movement of the stock material, thereby maintaining the axes of each compression wheel 100 and feed wheel 90 and corresponding support wheel 88 and 98, respectively, in vertical alignment.

The guide pins 140 are attached to a mounting bracket 142 which is attached to the adjacent side plate 80, 82. The guide pins 140 extend substantially perpendicular to the path of movement of the stock material and have thereon respective springs 144 which resiliently bias the floating bar 96 and thus the support wheels 88 and 98 toward the feed wheels 90 and the compression wheels 100, respectively. As shown, the springs 144 are interposed between the floating bar 96 and stops 146 on the remote ends of the guide pins 140. When material 34 is not being fed through the machine 20, the springs 144 will resiliently hold the wheels of each pair against one another, or with a small gap therebetween by reason of the floating bars 96 engaging the mounting brackets 142, or the shafts 94 and 104 against ends of the slots 148.

The guide pins 140 may extend through holes in the outer casing 28 as illustrated in FIG. 5 and the outer ends 146 of the guide pins 140 may be slotted or otherwise configured to receive an adjustment tool, such as a screw driver, for turning the guide pins. By turning the guide pins, which are threaded into the mounting brackets 142, the biasing force may be adjusted.

In the illustrated embodiment, as shown in FIGS. 24, the two shafts 92 and 102 are driven positively by the motor 26, the shaft 102 through a drive chain 150 to the motor 26 and the shaft 92 through a second drive chain 152. Drive chain 150 is secured to the motor 26 via sprocket 154 and shaft 102 via sprocket 155. The second drive chain 152 is secured to shaft 102 via sprocket 156 and shaft 92 via sprocket 157. It will be appreciated, however, that other drive mechanisms and arrangements may be employed if desired, such as gear trains.

The machine 20 also may include a guide chute 106 (FIG. 2) between the side plates 80 and 82. In the illustrated embodiment the guide chute 106 is substantially rectangular in cross section. As shown, the support wheels 88 (FIG. 3) and 98 extend into the interior of the guide chute 106 through slots 108 (FIG. 2) in the top wall of the chute 106, whereas the feed wheels 90 (FIG. 3) and compression wheels 100 extend through slots in the bottom wall of the chute 106.

Rotation of the shafts 92 and 102 effects corresponding rotation of the feed wheel 90 and compression wheel 100 for advancing the sheet material through the feeding and crumpling assembly 24. As discussed further below, the feed wheel 90 coacts with the support wheel 88 to feed the stock material at a rate greater than the rate at which the material is fed or passed between the compression wheel 100 and support wheel 98. In the illustrated embodiment, this is effectuated by rotating the feed wheel 90 and compression wheel 100 such that the circumferential speed of the feed wheel 90 is greater than the circumferential speed of the compression wheel 100. The ratio of the circumferential speeds preferably falls in the range of about 1.7:1 to about 2:1, which ratios can be achieved by an appropriate sizing of the sprockets 154 and 155, for example.

As shown in FIGS. 3 and 5, each feed wheel 90 is generally cylindrical in shape, with a middle portion in the form of an annular groove 156 which, for example, may have an approximately semi-circular cross section or a rectangular cross-section. The feed wheel 90 also has opposite axial end portions, each of which has a cylindrical periphery or circumference forming arcuate areas 160 interrupted by flat faces 158. The flat faces 158 of one axial end portion are transversely aligned with the arcuate areas 160 of the other axial end portion. The arcuate areas 160 are preferably knurled or otherwise provided with friction-enhancing means, such as ribs or crenellations, for relatively slip free engagement with the stock material.

As further shown in FIGS. 3 and 5, each support wheel 88, which coacts with a feed wheel 90, has a generally cylindrical shape at axial end portions 162 thereof which are disposed on opposite sides of a middle section where there is provided a radially outwardly protruding annular rib 164 which preferably is rounded, as shown. The cylindrical end portions 162 preferably are knurled or otherwise provided with friction-enhancing means, such as ribs or crenellations, for relatively slip free engagement with the stock material.

The discrete sheets of stock material 34 (FIG. 1) pass between the wheels 88 and 90 of each feeding and crumpling assembly, and are fed forwardly by each feed wheel 90. The material 34 will be pinched along a region thereof with a variable force, as explained further below, by each support wheel 88, when passing between the arcuate areas 160 of axial end portions of the support wheel 88 and the cylindrical axial end portions 162 of each feed wheel 90. This region of the strip, however, will be relatively free to slip when passing between each of the flat faces 158 and the cylindrical axial end portions 162 of the support wheel 88. Because of the angular offset between the flat faces 158 of the axial end portions, the strip will be pulled alternately from each side of its longitudinal axis, instead of being pulled only axially. This imparts a transversely reciprocating twisting action or motion to the stock material.

In the illustrated embodiment, corresponding flat faces of the several feed wheels are laterally aligned, i.e., in phase; however, other arrangements wherein the flat faces are angularly offset from one feed wheel to another may be used. In this manner, the pulling action of each feeding and crumpling assembly may be varied to provide different transverse crumpling patterns across the width of the sheet material as it is pushed together and pulled apart laterally by the relatively adjacent feeding and/or crumpling assemblies. Furthermore, in the illustrated embodiment, the upstream and downstream assemblies 84 and 86, respectively, are evenly spaced and aligned along the path of the stock material. The transverse spacing between relatively adjacent assemblies, however, may be varied to provide different crumpling effects. Also, the downstream assemblies 86 may be staggered relative to the upstream assemblies 84, and the respective numbers thereof may be varied as well to obtain different crumpling patterns.

As shown in FIGS. 4 and 5, the compression wheel 100 of each downstream assembly 86 is generally cylindrical in shape and has two end portions 166 preferably crenelated or otherwise provided with friction-enhancing means, such as ribs or a knurled surface, for relatively slip free engagement with the stock material, separated by a radially relieved middle portion 168 which may have a smooth outer diameter surface. If desired, compression wheel 100 may be crenelated across its entire width (omitting the relieved middle portion 168) or other friction enhancing surface treatments may be utilized. The support wheel 98 is a cylinder which may have a smooth outer diameter surface or one provided with knurling or other friction-enhancing means against which the crenelated end portions 166 of the compression wheel 100 will crease the stock material. The sheet of material 34 (FIG. 1) coming from the upstream assemblies 84 is pinched between the crenellations or ribbing of the compression wheel 100 and the outer diameter surface of the support wheel 98, with consequential creasing of the folds formed by the crumpling imparted to the stock material.

As shown in the embodiment illustrated in FIGS. 1 and 4, there is a downstream assembly 86 corresponding to each upstream assembly 84. However, a smaller number of complementary and corresponding feed wheels 100 and support wheels 98 of the downstream assembly 86 may extend across a greater portion of the width of the sheet stock material, or a single feed wheel and a single support wheel of the downstream assembly may extend across the entire width of the sheet stock material.

The force exerted by the springs 144 preferably is distributed in such a way that the pressure exerted by the wheel 88 against wheel 90 is greater than that exerted by the wheel 98 against wheel 100. Also, as was described above, the upstream assemblies 84 are driven to produce a feed rate (upstream feed rate) which is greater than the feed rate produced (or permitted) by the downstream assemblies 86 (downstream feed rate). The result is that the sheet of material leaving the upstream assemblies 84 is going to be retarded by the wheels 98 and 100 of the downstream assemblies 86. As a result, the material 34 (FIG. 1) will be longitudinally crumpled between the upstream and downstream assemblies 84 and 86, respectively. Crumpling of the material 34 results from this difference in feed rates between the upstream assemblies 84 and downstream assemblies 86, and the back and forth pulling/pushing, twisting or transversely reciprocating motion or action effected by the upstream assemblies 84.

For further information regarding each individual feeding and crumpling assembly 24 similar to that just described, reference may be had to European Patent Application No. 94440027.4, filed Apr. 22, 1994 and published on Nov. 2, 1995 under Publication No. 0 679 504 A1, which is hereby incorporated herein by reference. However, in the machine 20 of the present invention, the transverse row of feeding and crumpling assemblies effects crumpling across the full width of the sheet material.

Figure 6:
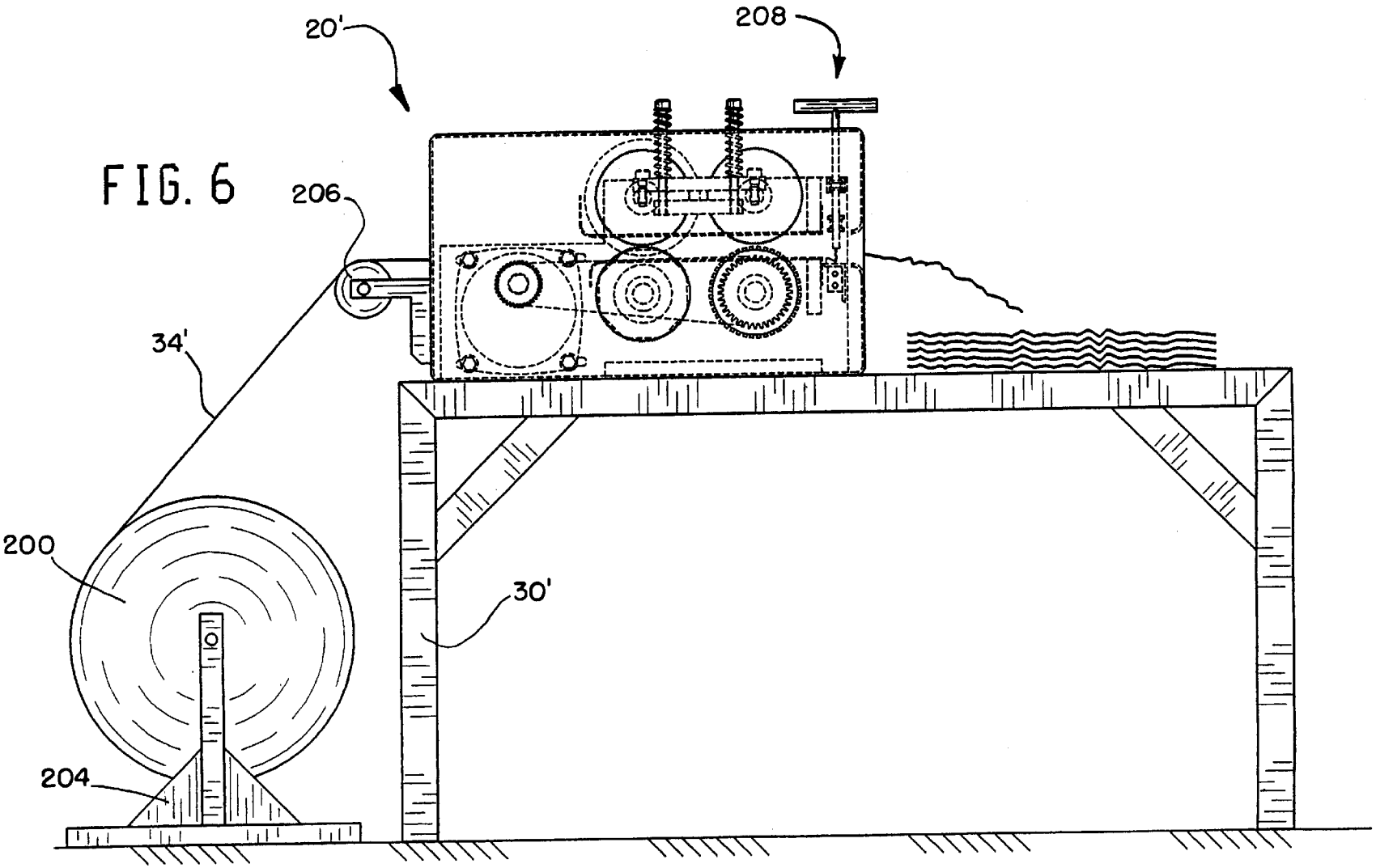
FIG. 6 is a side view of another embodiment of a cushioning conversion machine according to the invention, with the side wall of the machine's outer casing nearest the viewer broken away to permit viewing of internal machine components, and with the machine situated on a table, and supplied with continuous sheet stock material from a floor supported supply roll.

In FIG. 6, another embodiment of machine 20' is shown supported on a table 30' with continuous sheet stock material 34' supplied from a stock roll 200 supported by a stand 204. The stand 204 is positioned on the floor and the stock material 34' is fed upwardly to the machine 20', although other positions, such as on top of the machine 20' with the stock material 34' being fed downwardly to the machine 20', would also work. In either case and regardless of the angle at which the stock material 34' is fed from a supply thereof to the machine 20', a constant entry roller 206 at the upstream end of the machine 20' properly directs the stock material 34' into the machine 20'.

The stock material 34' preferably consists of a web of sheet stock material of one or more plies. A preferred stock material 34' consists of a biodegradable, recyclable and reusable material such as paper and more particularly 30–50 pound basis weight Kraft paper.

The machine 20' also includes a device of any desired type for severing the continuous crumpled web or strip into sections of desired length, which device may be, for example, the illustrated severing assembly 208 (FIG. 6). A severing assembly is not necessary, however, if the strip of cushioning can be severed by tearing, for example, as in the case where the stock material is supplied with perforations therein defining laterally extending tear lines. The strip severing assembly 208 divides or separates the crumpled cushioning exiting from between the downstream assemblies 86' into sections of desired length. In the illustrated embodiment, the severing assembly 208 is in the form of a cutting assembly that cuts the crumpled cushioning to form a cushioning product of desired length. In this manner, the length of the cushioning product may be varied depending on the intended application.

Figure 8:
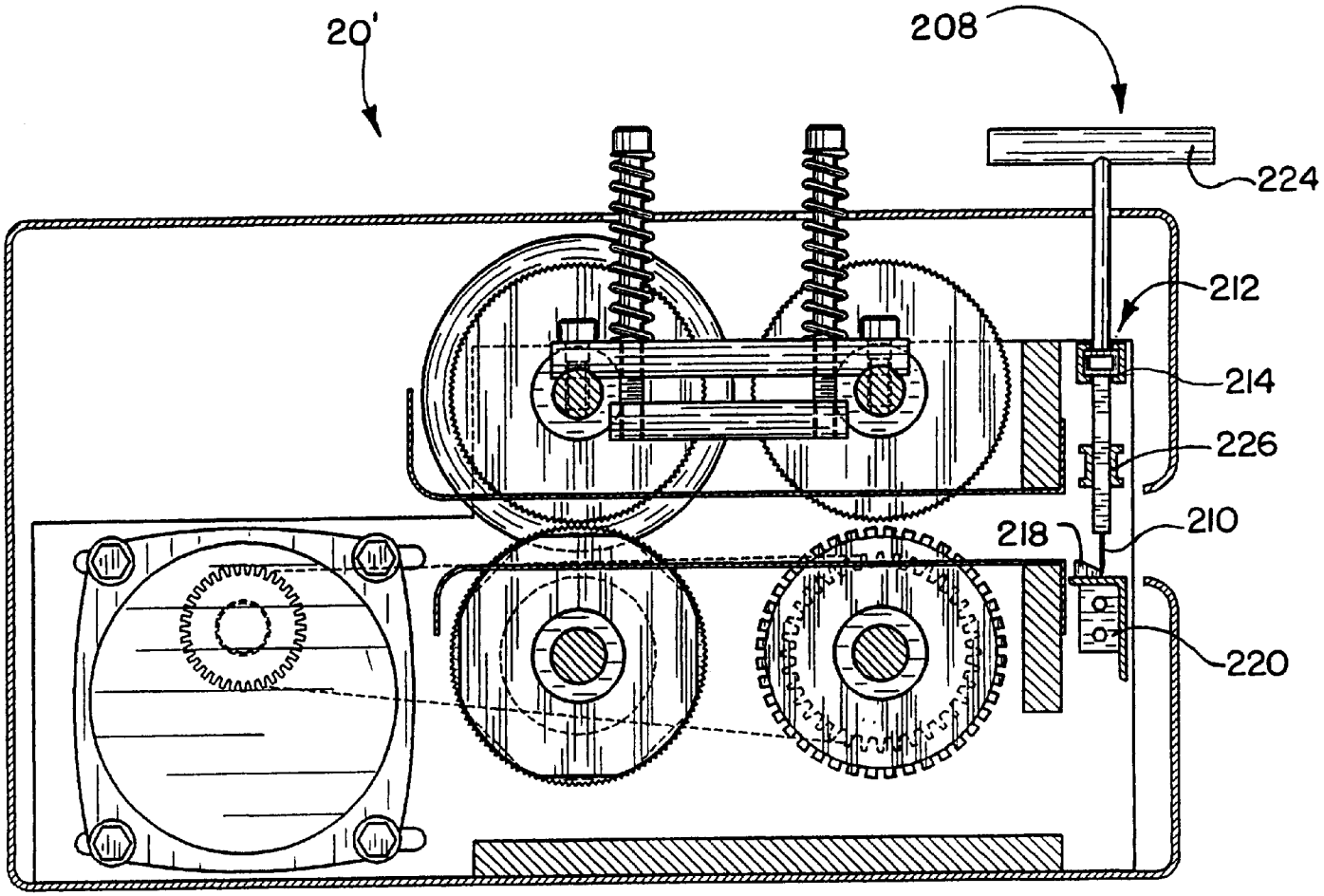
FIG. 8 is a sectional view taken along the line 8—8 of FIG. 7.

As illustrated in FIGS. 7 and 8, the severing assembly 208 includes a severing member 210 mounted to a carriage 212. The carriage 212 rides within a support guide 214 attached to the side members 80' and 82'. The severing member 210 may be, for example, a thin blade mounted for lateral movement in a plane perpendicular to the path of the converted strip of cushioning. The severing blade 210 is formed with a sharp severing or knife edge 216 which is inclined to the movement direction of the severing member 210. As illustrated, the edge 216 is at about a thirty degree angle.

The severing assembly 208 also includes a blade guide or track 218. The blade guide 218 is mounted to a horizontal frame member 220 which is attached to the side members 80' and 82'. The blade guide 218 provides a blade path which extends parallel to and directly below the support guide 214. The blade guide 218 has a top surface 222 which is flush with the bottom of the guide chute 106'. The severing assembly 208 also includes a handle 224 attached to the severing member 210. When the handle 224 is used to move the carriage 212 across the support guide 214, the inclined edge 216 of the severing member 210 squeezes the converted sheet material against the top surface 222 which forms a reaction surface for the severing member 210. The converted sheet material is severed by the combined effect of the inclined sharp edge 216 and the reaction surface 222 of the blade guide 218.

Further assisting the alignment of the severing member 210, the severing assembly 208 includes an alignment guide 226 below the support guide 214 and above the blade guide 218 which aligns the severing member 210 directly below the support guide 214 and directly above the blade guide 218. The handle 224 may have the illustrated T-shape, with the stem thereof extending through a slot in the outer casing 28' so as to connect with the carriage 212. Other handle shapes may be used in place of the T-shaped handle.

The particular construction and operation of the severing assembly is not essential to the present invention. However, reference may be had to U.S. patent application Ser. No. 08/386,355 for a severing assembly similar to that illustrated, or to U.S. patent application Ser. Nos. 08/110,349 and 08/478,256 for other types of severing assemblies which also could be utilized. Reference may also be had to U.S. patent application Ser. No. 08/486,911 for details of a single handle operator for operating the severing assembly and also for controlling the motor 26'. These patent applications are hereby incorporated herein by reference for their showings of severing and handle operator assemblies. The remaining components of the cushioning conversion machine 20' are essentially the same as those in machine 20, described above and shown in FIGS. 1–5.

Figure 9:
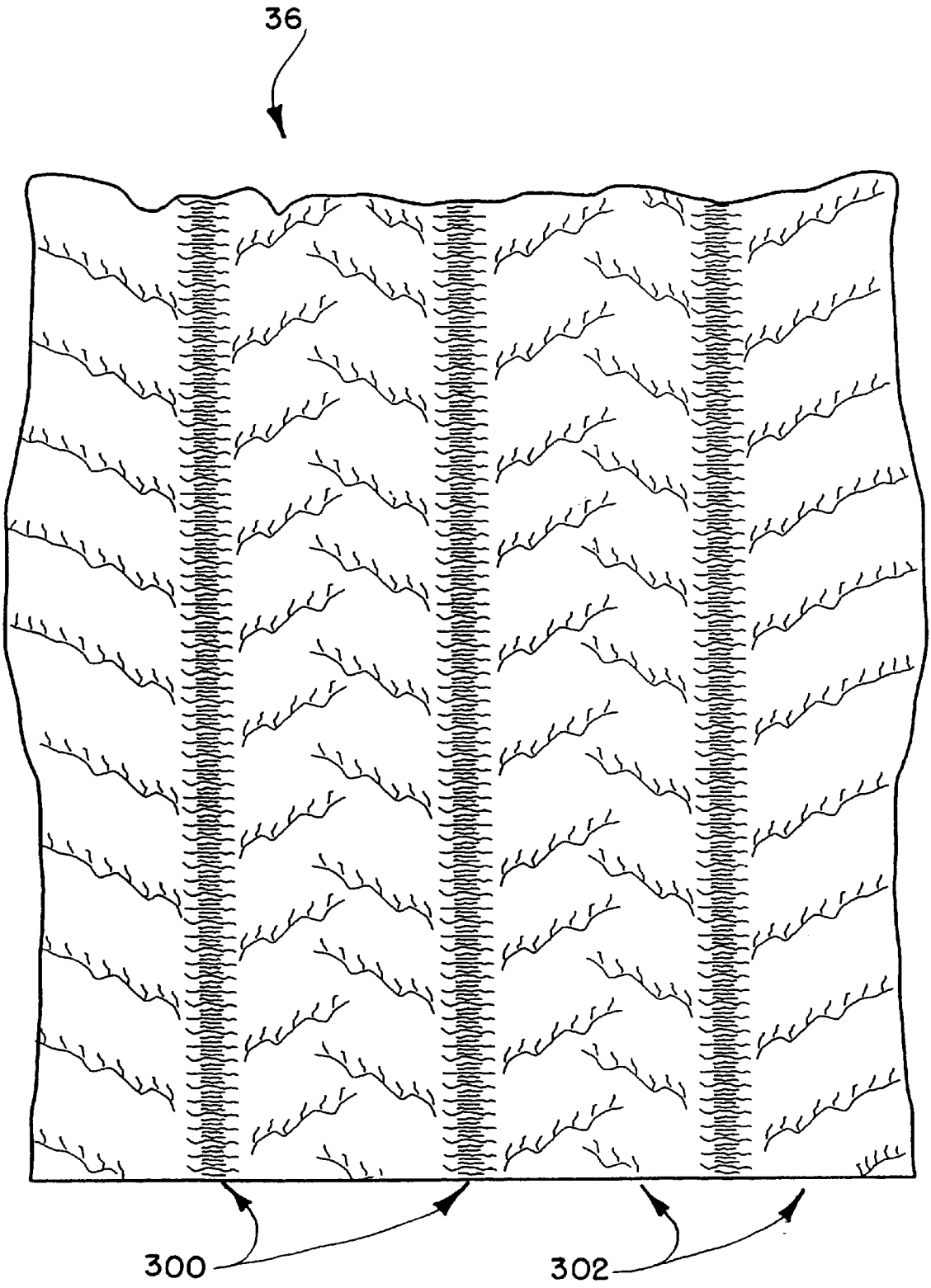
FIG. 9 is a fragmentary plan view of a cushioning surface wrap produced in accordance with the invention.

FIG. 9 illustrates a preferred surface wrap 36 produced by the cushioning conversion machine 20 (FIG. 1). The surface wrap 36 has a plurality of longitudinally extending cushion regions 302 transversely spaced apart by relatively flatter and narrower feeding trails 300 created by the feeding and crumpling assemblies. The cushion regions 302 include a herringbone arrangement of folds. The cushion regions 302 are less compressed and the folds are looser and more open (the inside angles made by the folded material generally are greater) than in the feeding trails 300 which are more compressed with tighter, more closed folds. As a result, the surface wrap 36 has more loft than the uncrumpled sheet stock material.

In use, the surface wrap 36 may be used to wrap and/or surround an object to be protected. An advantage of the cushioning surface wrap 36 is that it may be easily arranged to, conform to the shape of the object.

Figure 10:
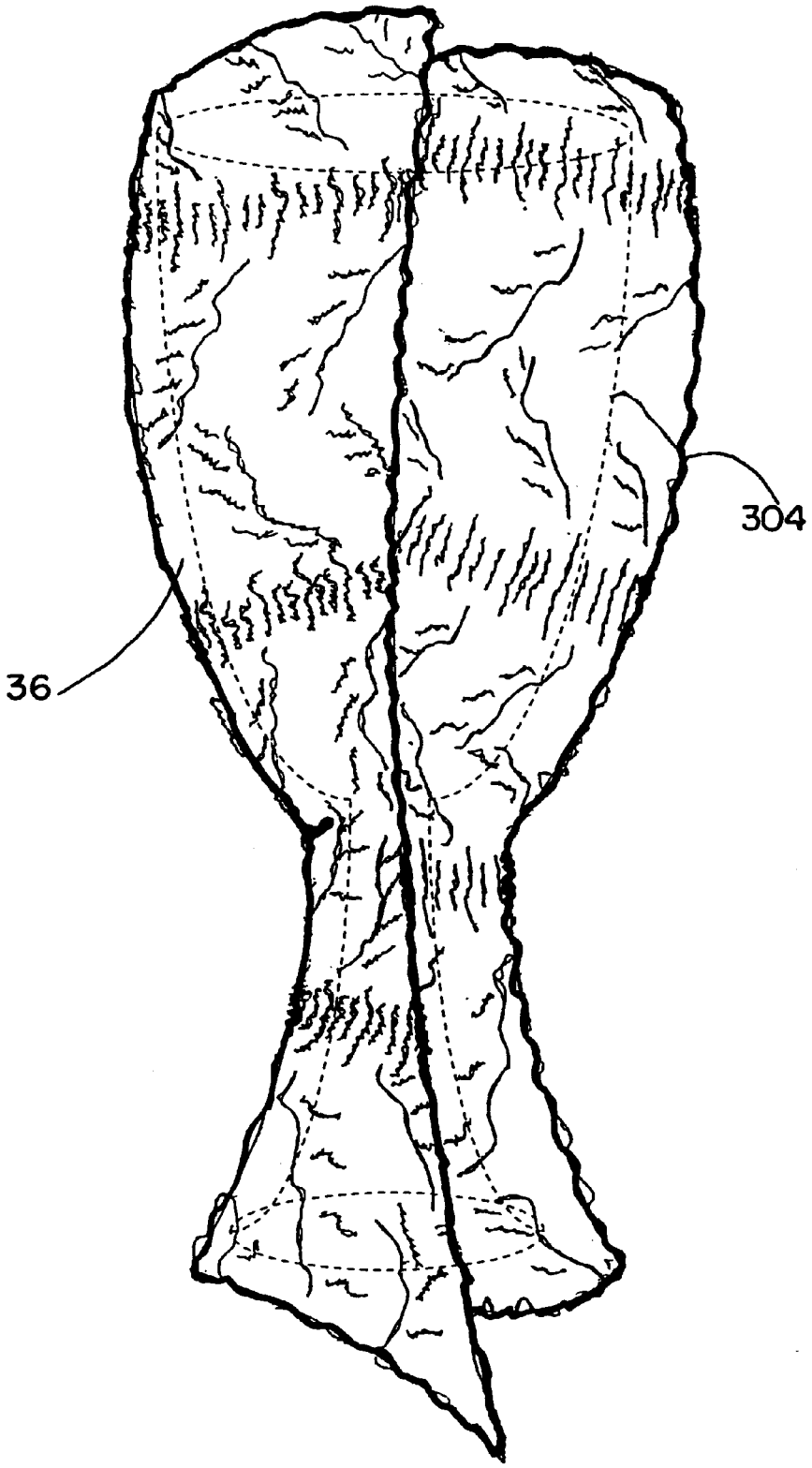
FIG. 10 is a view of a cushioning surface wrap applied to an object to be protected in accordance with the invention.

FIG. 10 illustrates the use of the surface wrap 36 illustrated in FIG. 9. The surface wrap 36 may be wrapped around the object to be wrapped 304, such as a wine glass. As illustrated, the surface wrap 36 cushions while generally following the irregular contour of the object to be wrapped 304.

Although the invention has been shown and described with respect to a certain preferred embodiment or embodiments, it is obvious that equivalent alterations and modifications will occur to others skilled in the art upon the reading and understanding of this specification and the annexed drawings. The present invention includes all such equivalent alterations and modifications. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the described structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A cushioning conversion machine for making a cushioning product from a flat sheet stock material, comprising a plurality of upstream assemblies which advance the sheet stock material with a transversely reciprocating motion and at least one downstream assembly which retards the advance of the stock material, thereby cooperating with the upstream assemblies to longitudinally crumple the stock material and to impart loft to the stock material; wherein each upstream assembly includes a support wheel and a feed wheel, the support wheel of the upstream assembly has axial end portions on either side of an annular groove, each axial end portion has a plurality of flat faces alternating with arcuate areas about the circumference thereof, the flat faces of one axial end portion are transversely aligned with the arcuate areas of the other axial end portion, the feed wheel having axial end portions on either side of an annual rib which extends within the annular groove of the support wheel, the axial end portions of the feed wheel cooperating with the axial end portions of the support wheel to engage the sheet stock material therebetween, and the upstream assemblies are laterally spaced apart across a planar path of the sheet stock material to effect twisting of regions of the sheet stock material about axes extending out of the plane of the sheet stock material, the regions of stock material collectively extending across substantially the full width of the path of the sheet stock material, the laterally spaced apart upstream assemblies cooperating to laterally crumple the stock material therebetween.

2. A cushioning conversion machine as set forth in claim 1, wherein the upstream assemblies feed the sheet stock material at a feed rate greater than the feed rate at which the downstream assembly passes the sheet stock material.

3. A cushioning conversion machine as set forth in claim 1, wherein the arcuate areas of the support wheel have friction enhanced surfaces.

4. A cushioning conversion machine as set forth in claim 2, wherein each downstream assembly includes a support wheel and a compression wheel, wherein the support wheel has a friction enhanced surface for gripping the crumpled stock material and creasing the folds against the compression wheel.

5. A cushioning conversion machine as set forth in claim 1, including a stock supply assembly adapted to supply the sheet stock material in lengths related to a desired length of the cushioning product.

6. A cushioning conversion machine as set forth in claim 1, including a stock supply assembly adapted to supply a continuous web of the sheet stock material whereby the upstream and downstream assemblies will produce a continuous web having crumpled portions, and wherein the machine further comprises a severing assembly for severing the continuous web into sections related to a desired length of the cushioning product.

7. A cushioning conversion machine as set forth in claim 1, wherein the axial end portions of the feed wheel have friction enhanced surfaces.

8. A cushioning conversion machine as set forth in claim 1, wherein each downstream assembly includes a support wheel and a compression wheel, wherein the compression wheel has a friction enhanced surface for gripping the crumpled stock material and creasing the folds against the support wheel.

9. A cushioning conversion machine for converting flat sheet stock material into cushioning products of a desired length, the machine comprising a conversion assembly which converts discrete lengths of the flat sheet stock material into the cushioning product, wherein the conversion assembly includes a plurality of upstream assemblies which feed the flat sheet stock material with a transversely reciprocating action and at least one downstream assembly which retards the advance of the stock material thereby cooperating with the upstream assemblies to longitudinally crumple the stock material and to impart loft to the stock material; wherein each upstream assembly includes a support wheel and a feed wheel, the support wheel of the upstream assembly has axial end portions on either side of an annular groove, each axial end portion has a plurality of flat faces alternating with arcuate areas about the circumference thereof, the flat faces of one axial end portion are transversely aligned with the arcuate areas of the other axial end portion, the feed wheel having axial end portions on either side of an annual rib which extends within the annular groove of the support wheel, the axial end portions of the feed wheel cooperating with the axial end portions of the support wheel to engage the sheet stock material therebetween, and the upstream assemblies are laterally spaced apart across a planar path of the sheet stock material to effect twisting of regions of the sheet stock material about axes extending out of the plane of the sheet stock material, the regions collectively extending across substantially the full width of the path of the sheet stock material, the laterally spaced apart upstream assemblies cooperating to laterally crumple the stock material therebetween.

10. A cushioning conversion machine as set forth in claim 9, wherein the upstream assemblies operate to feed the sheet stock material at a feed rate greater than the feed rate at which the downstream assembly operates to pass the sheet stock material.

11. A method of making a cushioning product from flat sheet stock material, comprising the steps of:

supplying the flat sheet stock material to a plurality of upstream assemblies that are laterally spaced apart across the width of the flat sheet stock material;

advancing the sheet stock-material with the upstream assemblies and concurrently imparting to the sheet stock material a transversely reciprocating motion to effect twisting of the sheet stock material in respective regions about axes extending out of the plane of the sheet stock material at respective regions collectively extending across substantially the full width of the sheet stock material, and laterally crumpling the regions of sheet stock material between the cooperating upstream assemblies; and retarding the advancement of the stock material through at least one downstream assembly downstream of the upstream assemblies;

whereby the stock material becomes longitudinally crumpled through the cooperation of the advancing and retarding steps, thereby increasing the loft of the cushioning product compared to the flat sheet stock material.

12. A method as set forth in claim 11, wherein retarding the sheet stock material results from the upstream assemblies advancing the sheet stock material at a feed rate greater than the feed rate at which the downstream assembly is passing the sheet stock material therethrough.

13. A method as set forth in claim 11, wherein the retarding step includes creasing the crumpled stock material so that the cushioning product retains a resilient crumpled state.

14. A method as set forth in claim 11, wherein the supplying step includes supplying sheet stock material having lengths related to a desired length of the cushioning product.

15. A method as set forth in claim 11, wherein the supplying step includes supplying sheet stock material that is a continuous web whereby the converting step will produce a continuous web having crumpled portions and wherein the method further comprises the step of severing the continuous web into sections related to a desired length of the cushioning product.

16. A method as set forth in claim 15, wherein the supplying step includes supplying sheet stock material that is biodegradable, recyclable, and made from a renewable resource.

17. A method as set forth in claim 16, wherein the supplying step includes supplying sheet stock material that is paper.

18. A method as set forth in claim, 17, wherein the supplying step includes supplying sheet stock material that is Kraft paper.

19. A method as set forth in claim 18, wherein the supplying step includes supplying sheet stock material having a plurality of superimposed plies of Kraft paper.

20. A cushioning surface wrap produced by the method of claim 11.

21. A method of surface wrapping an article for cushioning purposes, comprising the step of wrapping the cushioning product produced by the method of claim 11 around the surface of the article.

* * * * *